US007082696B2

(12) United States Patent
Wu

(10) Patent No.: US 7,082,696 B2
(45) Date of Patent: Aug. 1, 2006

(54) SOLE STRUCTURE OF GOODYEAR'S DUAL-INTAKE AIR-CAPSULE SHOES

(76) Inventor: Chien-I Wu, No. 29, Alley 120, Lane 29, Lung-Tung Road, Chung-Li City, Tao-Yuan Hsien (TW)

( * ) Notice: Subject to any disclaimer, the term of this patent is extended or adjusted under 35 U.S.C. 154(b) by 40 days.

(21) Appl. No.: 10/886,311

(22) Filed: Jul. 7, 2004

(65) Prior Publication Data

US 2006/0005423 A1 Jan. 12, 2006

(51) Int. Cl.
*A43B 7/08* (2006.01)

(52) U.S. Cl. ..... 36/3 B

(58) Field of Classification Search ..... 36/3 B, 36/3 R, 3 A

See application file for complete search history.

(56) References Cited

U.S. PATENT DOCUMENTS

| | | | | |
|---|---|---|---|---|
| 4,860,463 | A * | 8/1989 | Pin | 36/3 B |
| 4,999,932 | A * | 3/1991 | Grim | 36/88 |
| 5,477,626 | A * | 12/1995 | Kwon | 36/3 B |
| 6,463,679 | B1 * | 10/2002 | Buttigieg | 36/3 B |
| 2003/0188451 | A1 * | 10/2003 | Wu | 36/3 B |

FOREIGN PATENT DOCUMENTS

| | | |
|---|---|---|
| TW | 371846 | 2/1999 |
| TW | 91201848 | 2/2002 |
| TW | 93200057 | 1/2004 |

* cited by examiner

*Primary Examiner*—Ted Kavanaugh
(74) *Attorney, Agent, or Firm*—Morris, Manning & Martin; Tim Tingkang Xia, Esq.

(57) ABSTRACT

A sole structure of Goodyear's dual-intake air-capsule shoes includes a sole formed with a vent slot; a heel portion provided with an air-capsule receptacle, in which a T-type intake slot is disposed between the vent slot and the air-capsule receptacle, and two intakes are arranged by side of the T-type air-intake slot; an air capsule provided with a bottom end formed with a fixing hole and an elastic pillar fixed to the fixing hole of the air capsule for supporting the capsule. The level of those intakes is lower than that of a sole's bottom face. There are front sole lines formed on the sole's bottom face and a heel arranged on the sole for direct contact to the ground. A connection part is formed with an intake, while the heel is provided with a channel. Every intake or outlet is provided with a one-way valve such that air is allowed to flow in one direction, that is, to enter the capsule through the intakes and leave the capsule through the outlets.

7 Claims, 10 Drawing Sheets

SOLE STRUCTURE OF GOODYEAR'S DUAL-INTAKE AIR-CAPSULE SHOES

BACKGROUND OF THE INVENTION

1. Field of the Invention

The present invention relates to the improvements of Goodyear's air-capsule shoes, particularly to a sole structure of Goodyear's dual-intake air-capsule shoes.

2. The Prior Arts

It is already a common sense that people, at least an outnumbered great part of them, would suffer un-comfortableness from their feet caught in a ventilation-lacked sweaty and moldy corner after wearing shoes all day long, and this is particularly true during a sultry summer day.

For improvements, an air-capsule pump has been arranged in shoes later on, such that air can be pumped out and sucked in cyclically every time the compression and expansion action of the capsule pump is performed alternately while a wearer is walking. However, in some examples, the air-capsule pump is placed outside the heel base that doesn't provide a smooth air exchange. Taiwan Patent Publication No. 371846 discloses an air-capsule pump that is arranged in a recess of heel base such that air can be pumped into the shoe through the intake for air exchange when a wearer is walking to exert a downward pressure to the sole. However, because the air-capsule pump is arranged outside the heel base, it would require a larger force to tread shoes on the floor so that air can be sucked into the shoes through the lateral air intake for air exchange that does not seem to conform to the ergonomics very much. In another prior design, the present inventor teaches an air capsule having a single intake, which is more or less insufficient in sucking airflow. For improvements, a dual-intake structure is disclosed in Taiwan Patent Application No. 91201848. As shown in FIG. 1A, in a generic Goodyear's air-capsule shoe, an external stitching is usually applied to secure an upper body 13 to a sole 11, where an insole 131 has to be introduced and nailed onto the upper body 13 before the stitching is made. Therefore, an inner peripheral strip must be stitched to the insole 131 so that the upper body 13 and the insole 131 could be fixed by steel wire and stitched with an outer peripheral strip. However, because of the inner peripheral strip, the contact area between the upper body 13 and an air capsule 12 must be lessened to result in a smaller intake-outlet volume of the capsule. Moreover, in such case, the bottom pattern of the sole 11 has to be migrated (shrunk) inwards slightly to reserve a space for the stitching. Referring also to FIG. 1B, due to the inward migration of the heel 111 of the sole 11, an inward migration corridor 114 surrounding the whole bottom face of the sole 11 peripherally is formed. Hence, as indicated in FIG. 2, in addition to the unsightliness of a small heel, a pair of shoes like this would make a wearer feel unreal when treading the floor. Then, another improvement was made to permit no inward migration of the heel 111 of the sole 11 as shown in FIG. 3, in which a linear recess 22 is entrenched partly in a heel 21 to ensure the manner of keeping stitching an upper body 26 and a sole 25 together by using an external stitching 24. Taiwan Patent Application No. 93200057 discloses such an improvement. Though, it is possible for the sole 25 to accommodate a larger air capsule whatsoever, there is still a defect pending remedy that may cause obstacle or choke during burr trimming or grinding in a rear-stage process because air intakes 23 are opened on both sides of the heel 21.

SUMMARY OF THE INVENTION

The primary object of the present invention is to avoid the possible choke to be caused by burr during trimming and grinding taken in a shoe's rear-stage process and thereby save the cost for fabricating Goodyear's dual-intake air-capsule shoes.

In order to realize above object, a sole structure of Goodyear's dual-intake air-capsule shoes of the present invention is comprised of: a sole formed with a vent slot; a heel portion provided with an air-capsule receptacle, in which a T-type intake slot is disposed between the vent slot and the air-capsule receptacle, and two intakes are arranged by side of the T-type air-intake slot; an air capsule provided with a bottom end formed with a fixing hole and an elastic pillar fixed to the fixing hole of the air capsule for supporting the capsule. The level of those intakes is lower than that of a sole's bottom face. There are front sole lines (not shown) formed on the sole's bottom face and a heel arranged on the sole for direct contact to the ground to avoid slipping, enhance anti-friction, and raise sightly effect. There is also a connection part formed between the front sole lines and the heel for the same purposes as well. The connection part is formed with an intake, while the heel is provided with a channel. Two outlets and a T-type air-intake pipe are arranged on one side of the air capsule, in which one end of the T-type air-intake pipe is in connection with the air capsule, and the other is formed with two air intakes. Both the intake and the outlet are provided with a one-way valve such that air is allowed to flow in one direction, that is, to enter the capsule through the intakes and leave the capsule through the outlets, where the one-way valve is disposed at each intake and outlet.

The merits of the present invention may be summarized below: (1) Since an upper body is stitched by three-fourths of the bottom area thereof to combine with an insole, and the rest one-fourth area of the upper body near the heel end is not covered by the insole. Therefore, the air capsule in the receptacle is now exposed to the air after the upper body is stitched and fixed to the sole by an external stitching. When a user wears a pair of air-capsule shoes like this, there is only a shoe pad interfaced between his foot and the air capsule, that is, the user can tread on the air capsule directly, so that the air capsule bears a relatively larger depressing force to enlarge the intake and outlet air volume and obtain a better ventilation efficacy. (2) Since the intake of the air capsule opened in a lateral edge of the sole in a conventional capsule is substituted by an intake of a connection part in the sole's bottom face according to the air capsule structure of the present invention, such that the possible choke to be caused by burr when trimming and grinding is taken in a shoe's rear-stage process is avoidable. (3) The combination of an upper body with a sole by means of an external stitching for making air-capsule shoes can assure a firm bonding without degumming or detaching.

For more detailed information regarding advantages or features of the present invention, at least one example of preferred embodiment will be described below with reference to the annexed drawings.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

Figure 1A:
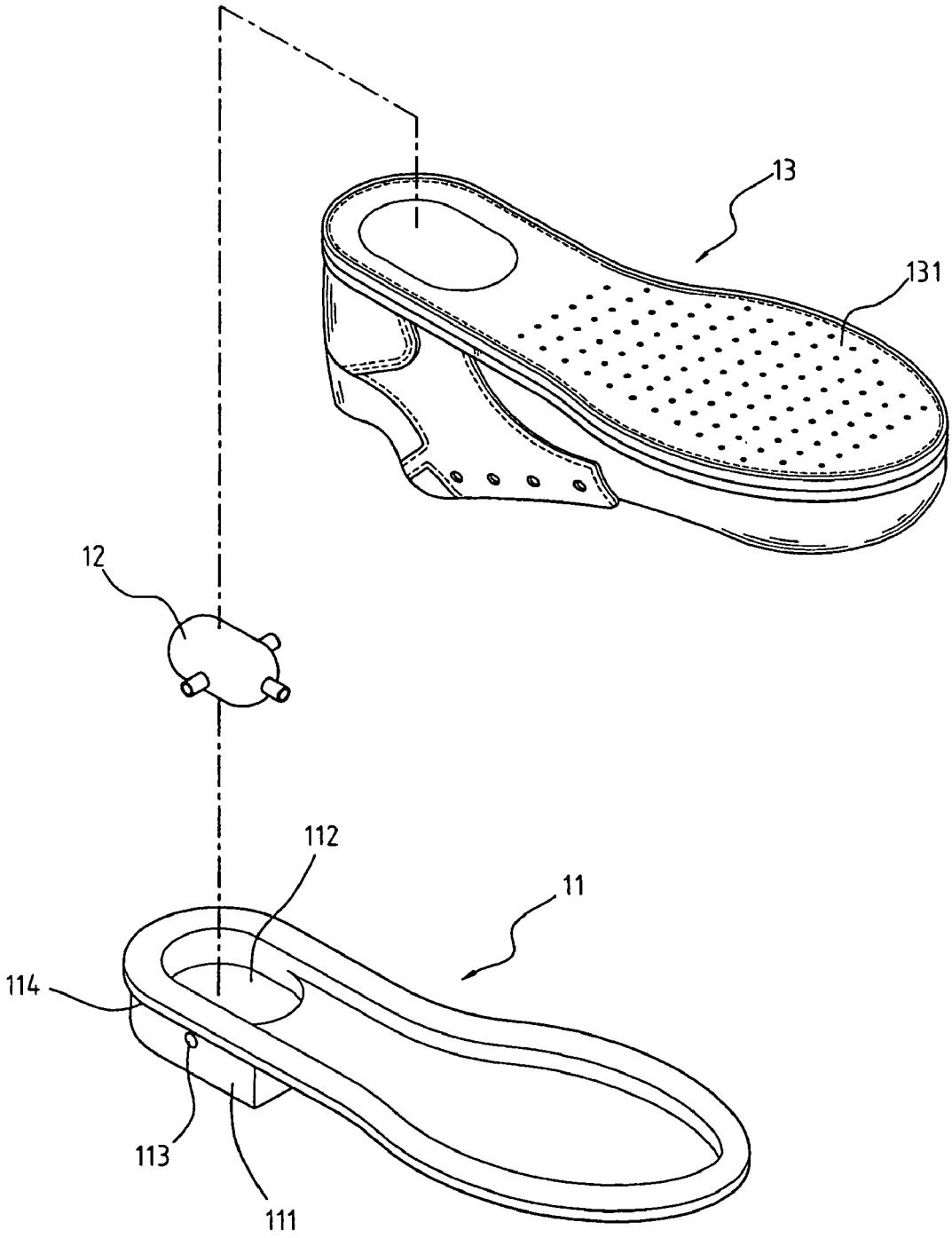
FIG. 1A (PRIOR ART)
FIG. 1A shows a conventional air-capsule structure of sole.
Figure 1B:
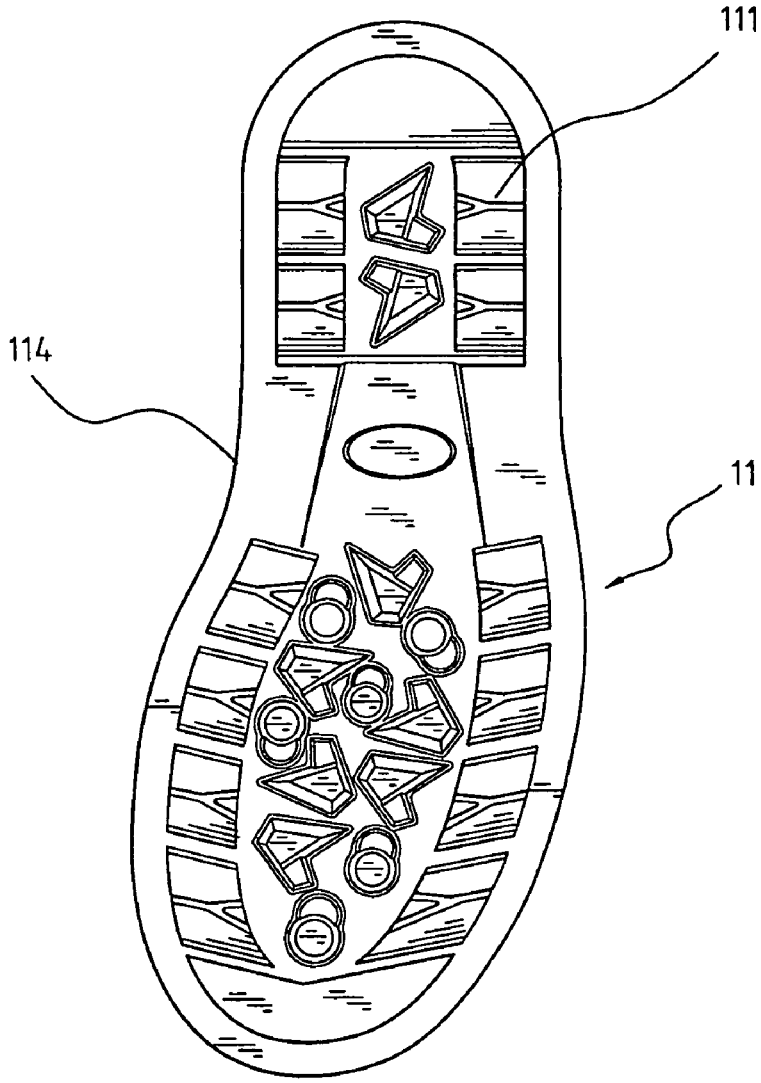
FIG. 1B (PRIOR ART)
FIG. 1B shows a conventional shrunk-inwards sole.
Figure 2:
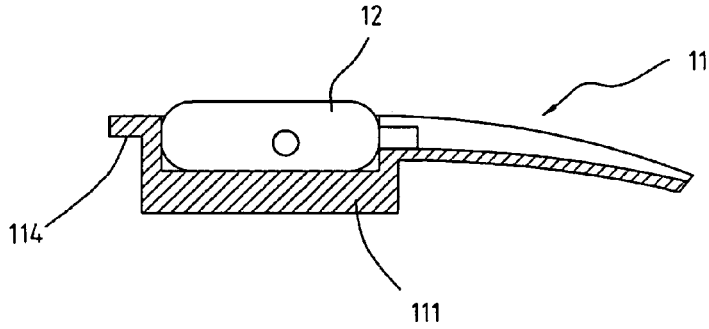
FIG. 2 (PRIOR ART)
FIG. 2 is a lateral view of the conventional shrunk-inwards sole.
Figure 3:
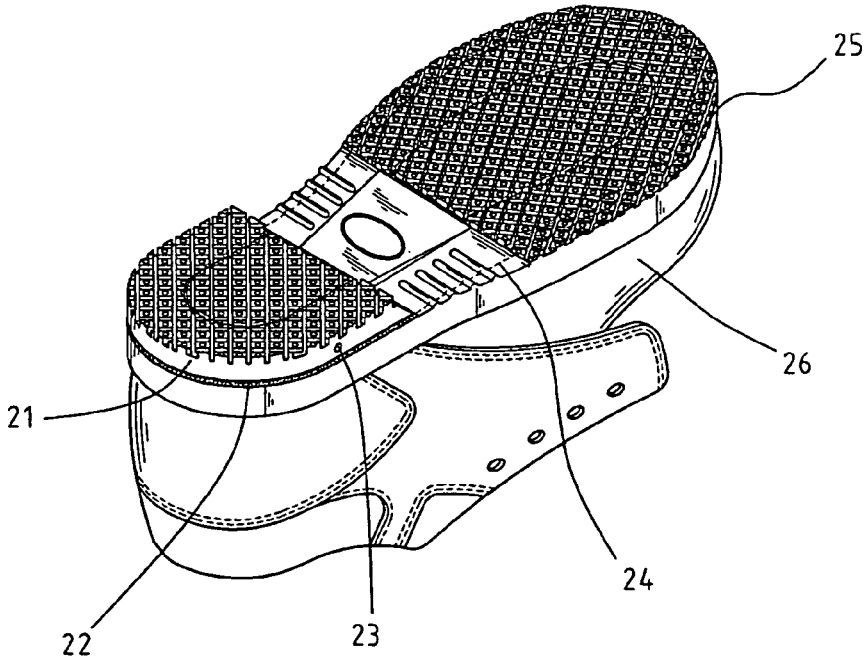
FIG. 3 (PRIOR ART)
FIG. 3 shows a conventional improved sole.
Figure 4:
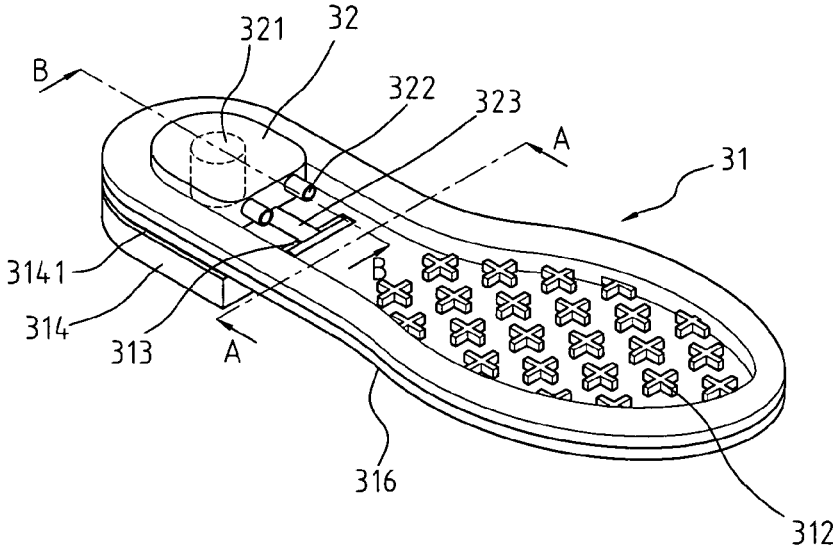
FIG. 4 is an assembled view of a sole of the present invention.
Figure 5:
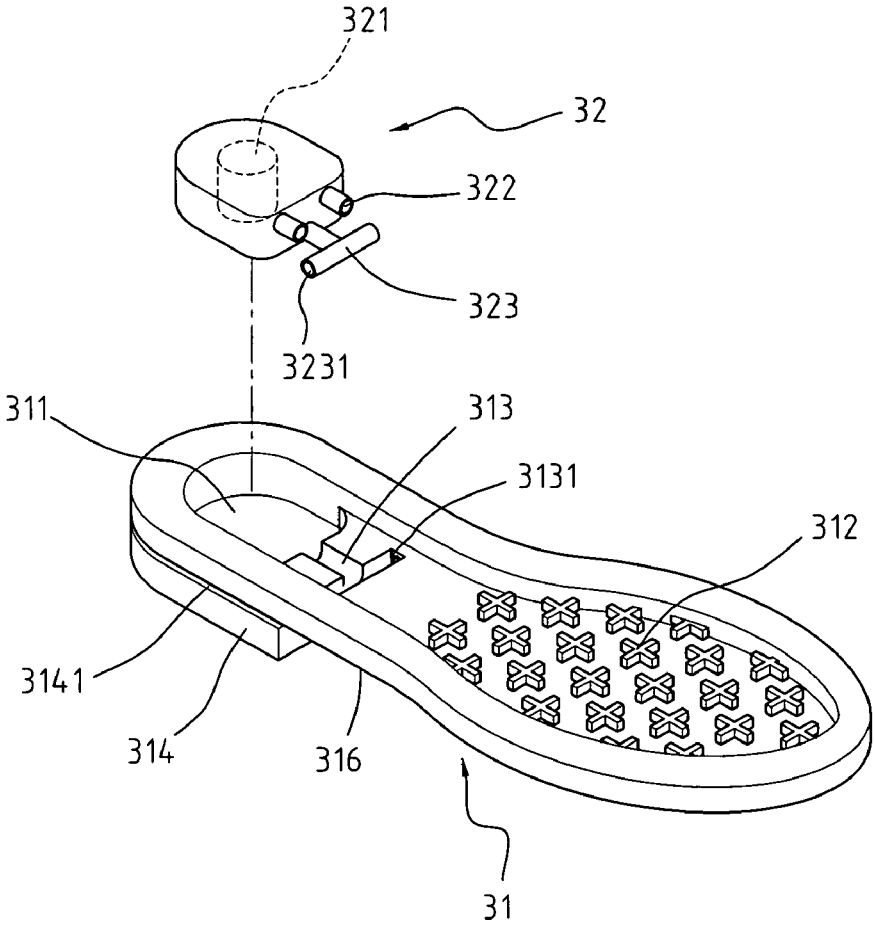
FIG. 5 is an exploded view of the sole of the present invention.

FIGS. 4 and 5 are an assembled view and an exploded view of a sole of the present invention, respectively. The sole structure of Goodyear's dual-intake air-capsule shoes is comprised mainly of a sole 31 and an air capsule 32.

The sole 31 is formed with a vent slot 312, and a heel portion 314 is provided with an air-capsule receptacle 311, in which a T-type intake slot 313 is disposed between the vent slot 312 and the air-capsule receptacle 311, and two intake apertures 3131 are arranged by side of the T-type air-intake slot 313. The level of those intake apertures 3131, namely, the position thereof, is lower than that of a sole's bottom face 316. There are front sole lines (not shown) formed on the sole's bottom face 316 and a heel 314 arranged on the sole 31 for direct contact to the ground to avoid slipping, enhance anti-friction, and raise sightly effect. There is also a connection part 315 formed between the front sole lines and the heel 314 for the same purposes as well. The connection part 315 is provided with intake apertures 3131, while the heel 314 is with a channel 3141 as indicated in FIG. 8.

The air capsule 32 has a bottom end formed with a fixing hole and an elastic pillar 321 fixed to the fixing hole of the air capsule 32 for supporting the capsule. Two outlets 322 and a T-type air-intake pipe 323 are arranged on one side of the air capsule 32, in which one end of the T-type air-intake pipe 323 is in connection with the air capsule 32, and the other is formed with two air intakes 3231. Each intake 3231 and each outlet 322 are provided with a one-way valve such that air is allowed to flow in one direction, that is, to enter the capsule through the intakes 3231 and leave the capsule through the outlets 322.

Figure 6:
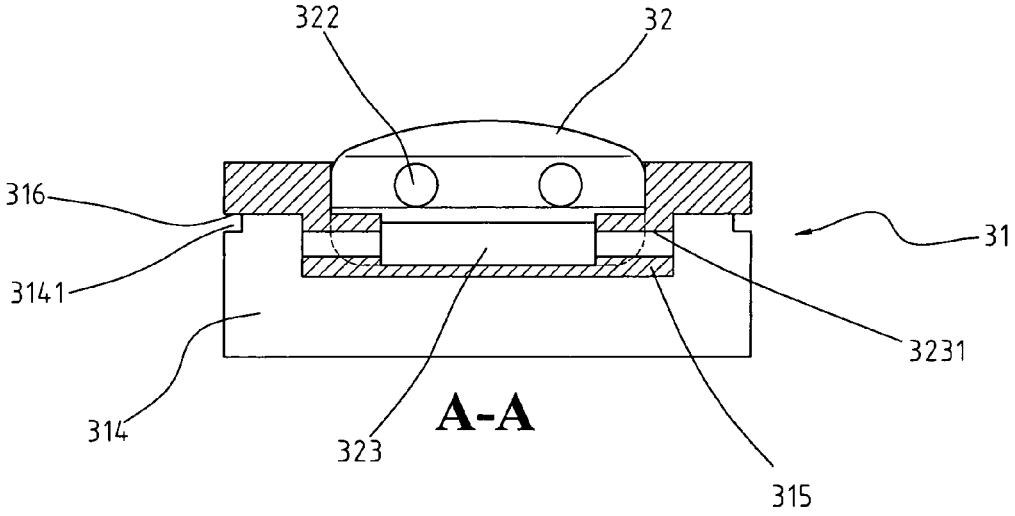
FIG. 6 is a cutaway sectional view of the sole of the present invention of A—A portion (viewed in a front-rear direction)
Figure 7:
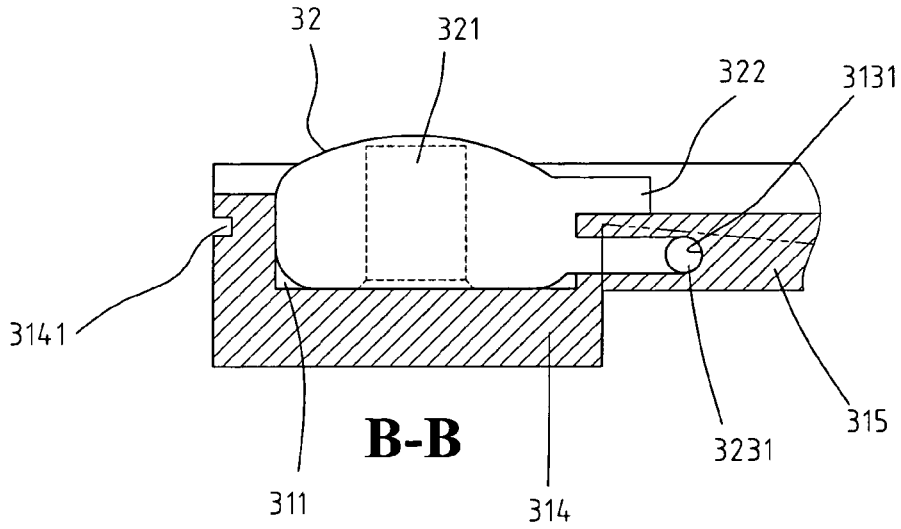
FIG. 7 is a cutaway sectional view of the sole of the present invention of B—B portion (viewed from a lateral direction)

FIG. 6 is a cutaway sectional view of the sole of A—A portion, and FIG. 7 is a cutaway sectional view of the sole of B—B portion of the present invention. The air-capsule receptacle 311 of the sole 31 and the T-type air-intake slot 313 are viewed in the figures. The air capsule 32 is fixed in the air-capsule receptacle 311 of the sole 31, and the T-type air-intake pipe 323 of the air capsule 32 is fixed in the air-intake slot 313 of the sole 31. It is also viewed that the intakes 3231 are not situated at the same level with the outlets 322, and when the air capsule 32 is placed in the air-capsule receptacle 311, each intake 3231 of the T-type air-intake pipe 323 of the air capsule 32 is aligned with the intake aperture 3131 so that the air outside can enter through the intake apertures 3131 of the sole 31 to flow into the air capsule 32 through the intakes 3231 of the air capsule 32.

Figure 8:
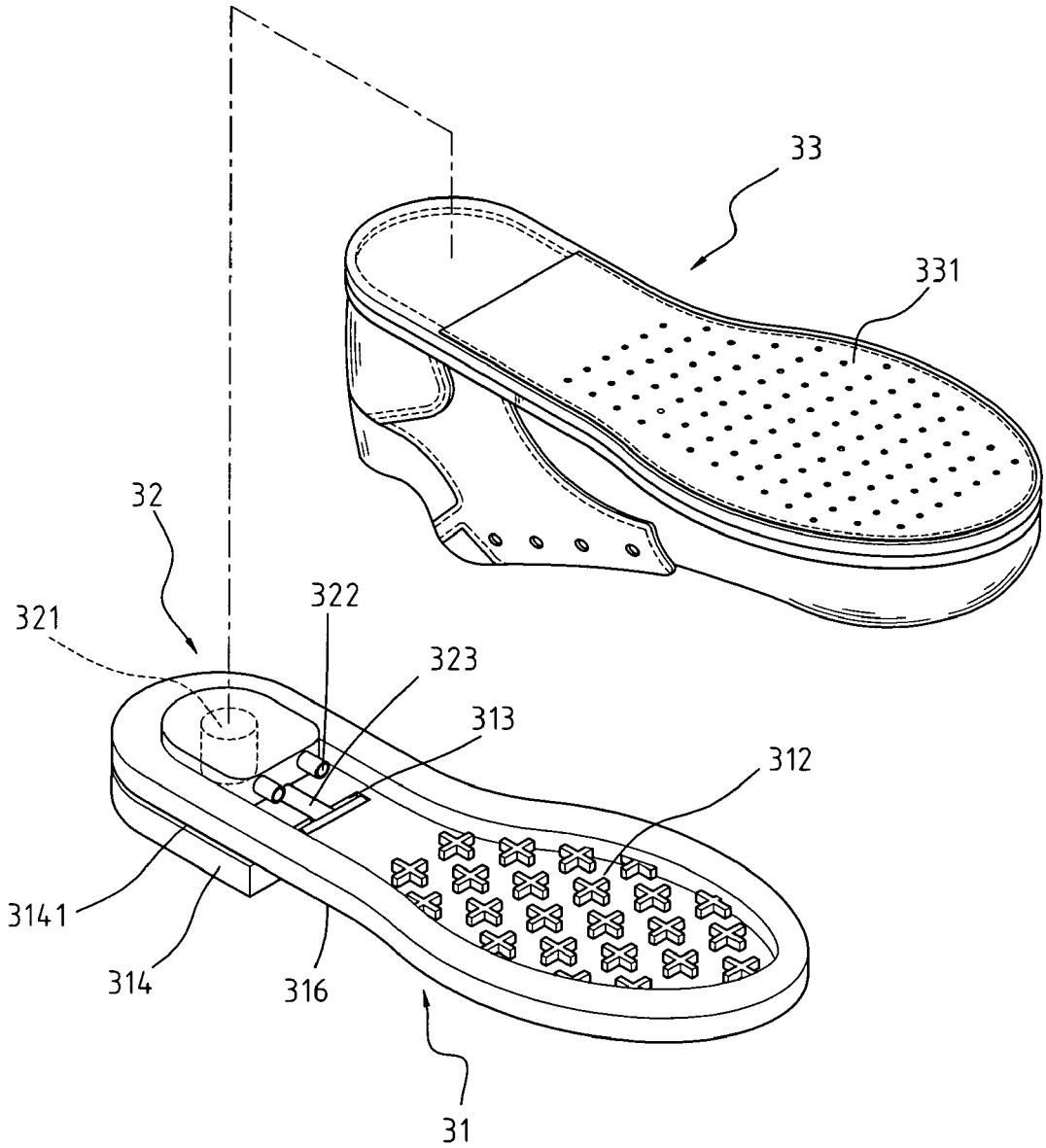
FIG. 8 is an exploded view of an upper body and a sole of the present invention.

FIG. 8 is an exploded view of an upper body and a sole of the present invention. It can be seen from this figure that the air capsule 32 and the T-type air-intake pipe 323 of the air capsule 32 are already fixed on the sole 31 and the T-type air-intake slot 313 of the sole 31, respectively, also the intake 3231 of the T-type air-intake pipe 323 is connected with the intake aperture 3131 of the connection part 315 on the sole 31. Moreover, an upper body 33 is stitched by three-fourths of the bottom area thereof to combine with an insole 331, and the rest one-fourth area of the upper body 33 near the heel end is not covered by the insole. Therefore, the air capsule 32 in the receptacle 311 is now exposed to the air after the upper body 33 is stitched and fixed to the sole 31 by an external stitching. When a user wears a pair of air-capsule shoes like this, there is only a shoe pad interfaced between his foot and the air capsule 32, that is, the user can tread on the air capsule 32 directly. Meanwhile, for protecting the air capsule 32 against an overlarge treading force or spoilage after a long-term use, the present invention is intended to adopt a previously improved air capsule 32 proposed by this inventor, in which an elastic pillar is arranged in the air capsule 32 to prolong the lifetime thereof.

Since treads are applied upon directly, the air capsule bears a relatively larger depressing force to enlarge the intake and outlet air volume and obtain a better ventilation efficacy, and because an external stitching is adopted to seam the upper body 33 and the sole 31 peripherally together, a channel 3141 is defined in a lateral surface of the heel 314 of the sole 31 to facilitate the stitching job.

According to the air capsule structure of the present invention, the intake 3231 of the air capsule 32 opened in a lateral edge of the sole 31 in a conventional capsule is substituted by an intake aperture 3131 of a connection part in the sole's bottom face 316 such that the possible choke to be caused by burr when trimming and grinding is taken in a shoe's rear-stage process is avoidable.

Figure 9:
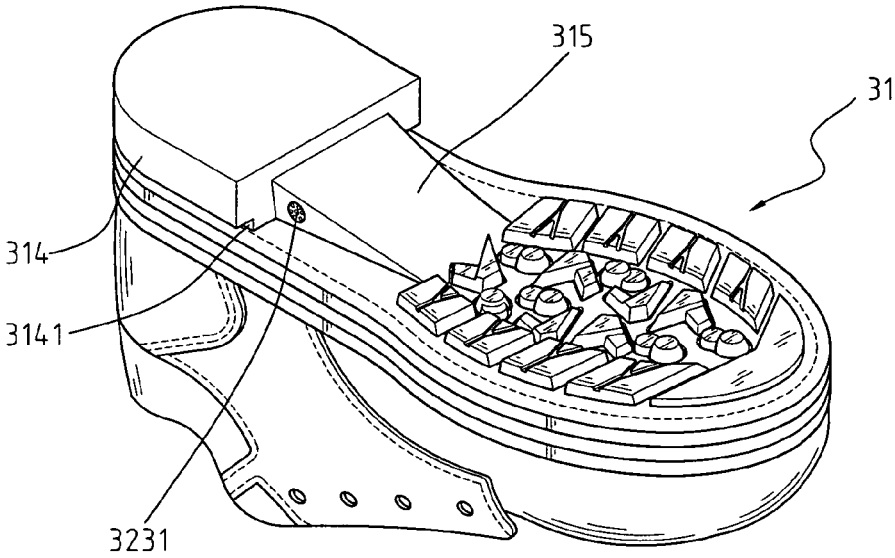
FIG. 9 is an application example of the present invention.

In short, the way to seam an upper body 33 and a sole 31 together to form an air-capsule shoe by means of an external stitching as shown in FIG. 9 is rarely seen so far, and we believe that it is a breakthrough in this field for heightening the fabrication efficiency of air-capsule shoe.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A sole structure of Goodyear's dual-intake air-capsule shoes, comprising:

a sole having a vent slot, and a heel portion provided with an air-capsule receptacle, in which a T-type intake slot is disposed by side of the vent slot; and a connection part formed on a bottom surface of the sole by side of a heel is provided at least an intake; and an air capsule having a bottom end formed with a fixing hole and an elastic pillar fixed to the fixing hole at the main body of the air capsule for supporting the capsule, in which two outlets and a T-type air-intake pipe having two intakes are arranged on one side of the air capsule;

wherein the sole is combined with an upper body by means of an external stitching; the air capsule is situated in an air-capsule receptacle; the T-type air-intake pipe of the capsule is fixed to the T-type intake slot in the sole, and the intakes of the T-type air-intake pipe are aligned with the intake apertures in the connection part in the sole.

2. The sole structure according to claim 1, wherein each outlet is provided with a one-way valve.

3. The sole structure according to claim 1, wherein each intake is provided with a one-way valve.

4. The sole structure according to claim 1, wherein the intakes and the outlets are not located at the same horizontal level.

5. The sole structure according to claim 1, wherein the T-type air intake slot has at least an intake of which the horizontal level is lower than that of a bottom surface of the sole.

6. The sole structure according to claim 1, wherein a channel is defined in a lateral surface of the heel.

7. The sole structure according to claim 1, wherein the upper body is stitched by three-fourths of the bottom area thereof to combine with an insole.

* * * * *